US011939718B2

(12) United States Patent
Rabbani et al.

(10) Patent No.: US 11,939,718 B2
(45) **Date of Patent: *Mar. 26, 2024**

(54) SYSTEMS AND METHODS FOR CLEANING FABRIC

(71) Applicants: Ali Rabbani, Verhulststraat (NL); Pedram Rabanne, Tehran (IR)

(72) Inventors: Ali Rabbani, Verhulststraat (NL); Pedram Rabanne, Tehran (IR)

( * ) Notice: Subject to any disclaimer, the term of this patent is extended or adjusted under 35 U.S.C. 154(b) by 0 days.

This patent is subject to a terminal disclaimer.

(21) Appl. No.: 18/075,477

(22) Filed: Dec. 6, 2022

(65) Prior Publication Data

US 2023/0095962 A1 Mar. 30, 2023

Related U.S. Application Data

(63) Continuation of application No. 17/504,818, filed on Oct. 19, 2021, now Pat. No. 11,519,127, which is a (Continued)

(51) Int. Cl.
*D06F 43/06* (2006.01)
*D06F 19/00* (2006.01)

(Continued)

(52) U.S. Cl.
CPC ..... *D06F 43/06* (2013.01); *D06F 19/00* (2013.01); *D06F 39/008* (2013.01); *D06F 39/088* (2013.01); *D06F 58/10* (2013.01)

(58) Field of Classification Search
None
See application file for complete search history.

(56) References Cited

U.S. PATENT DOCUMENTS

2009/0072883 A1 3/2009 Ehrlich et al.
2013/0198970 A1* 8/2013 Doh ..... D06F 25/00 8/137

(Continued)

FOREIGN PATENT DOCUMENTS

EA 017938 B1 4/2013
EP 2902540 A1 8/2015

(Continued)

OTHER PUBLICATIONS

PCT International Search Report and Written Opinion dated Dec. 16, 2021, International Application No. PCT/US2021/50218, pp. 1-6.

*Primary Examiner* — Cristi J Tate-Sims
(74) *Attorney, Agent, or Firm* — Outlier Patent Attorneys, PLLC

(57) ABSTRACT

An apparatus for cleaning a fabric article includes an emitting header that emits fluid towards the fabric article and a suction header that suctions the fluid emitted by the emitting header. The suction header and the emitting header are parallel to each other and separated from each other by a space. The space is configured for positioning the fabric article in the space so that fluid emitted by the emitting header flows through the fabric article towards the suction header. A washing appliance for cleaning a fabric article includes a detergent compartment, a control system monitor, a pump, a water compartment, an emitting header that emits fluid towards the fabric article, a suction header that suctions the fluid emitted by the emitting header, a screen disposed between the emitting header and the suction header, and a servo motor in communication with at least one of the emitting header and the suction header.

22 Claims, 16 Drawing Sheets

Related U.S. Application Data continuation of application No. 17/474,112, filed on Sep. 14, 2021, now abandoned.

(60) Provisional application No. 63/077,715, filed on Sep. 14, 2020.

(51) Int. Cl.

| | |
|---|---|
| ***D06F 39/00*** | (2020.01) |
| ***D06F 39/08*** | (2006.01) |
| ***D06F 58/10*** | (2006.01) |

(56) References Cited

U.S. PATENT DOCUMENTS

| | | | | |
|---|---|---|---|---|
| 2015/0167220 | A1* | 6/2015 | Diethart | D06C 3/08 68/5 A |
| 2018/0100262 | A1* | 4/2018 | Prushinskiy | D06F 35/00 |

FOREIGN PATENT DOCUMENTS

| | | | |
|---|---|---|---|
| WO | 2007104433 | A1 | 9/2007 |
| WO | 2015133796 | A1 | 9/2015 |
| WO | 2018030692 | A1 | 2/2018 |

* cited by examiner

SYSTEMS AND METHODS FOR CLEANING FABRIC

CROSS-REFERENCE TO RELATED APPLICATIONS

This application is a continuation of U.S. Non-Provisional patent application Ser. No. 17/504,818, filed Oct. 19, 2021, entitled "SYSTEMS AND METHODS FOR CLEANING FABRIC," which is a continuation of U.S. Non-Provisional patent application Ser. No. 17/474,112, filed Sep. 14, 2021, entitled "SYSTEMS AND METHODS FOR CLEANING FABRIC," which claims priority to U.S. Provisional Patent Application Ser. No. 63/077,715, filed Sep. 14, 2020, entitled "SYSTEMS AND METHODS FOR CLEANING FABRIC," the entire contents of which are incorporated herein by reference.

BACKGROUND

Field of the Art

The disclosure relates generally to cleaning fabric and more specifically to ecologically cleaning fabric.

Discussion of the State of the Art

Washing machines and dryers were developed to automate the process of cleaning clothes. Traditional washing machines were a convenient substitution for the washing of clothes by hand. Traditional dryers were a speedy substitution for air drying clothes. However, traditional washing machines use a lot of water to clean clothes. Additionally, traditional dryers use a lot of energy to dry clothes. Further, traditional washing machines and dryers put wear and tear on the fabric of clothes. What is needed is a way to clean fabric without the drawbacks of traditional washing machines and dryers.

SUMMARY

The present invention utilizes systems and/or methods for fabric cleaning. The systems and/or methods described herein, in accordance with an embodiment of the invention, may receive a piece of fabric. The systems and/or methods described herein may wet the piece of fabric. The systems and/or methods may clean the piece of fabric. The systems and/or methods may rinse the piece of fabric. The systems and/or methods may dry the piece of fabric. The systems and/or methods may steam the piece of fabric. The systems and/or methods may spray deodorant on the piece of fabric.

One benefit of the present invention is that the amount of water needed to wash clothing is greatly reduced. Another benefit is that the amount of energy needed to dry washed clothing is greatly reduced. An additional benefit is that the wear and tear on clothing associated with washing and drying clothing is greatly reduced.

BRIEF DESCRIPTION OF THE DRAWING FIGURES

The accompanying drawings illustrate several embodiments and, together with the description, serve to explain the principles of the invention according to the embodiments. It will be appreciated by one skilled in the art that the particular arrangements illustrated in the drawings are merely exemplary and are not to be considered as limiting of the scope of the invention or the claims herein in any way.

FIG. 1 illustrates a cross-sectional view of a system for cleaning fabric in accordance with an exemplary embodiment of the invention.

FIGS. 2A-E illustrate cross-sectional views of systems for cleaning fabric in accordance with exemplary embodiments of the invention.

DETAILED DESCRIPTION

Figure 1:
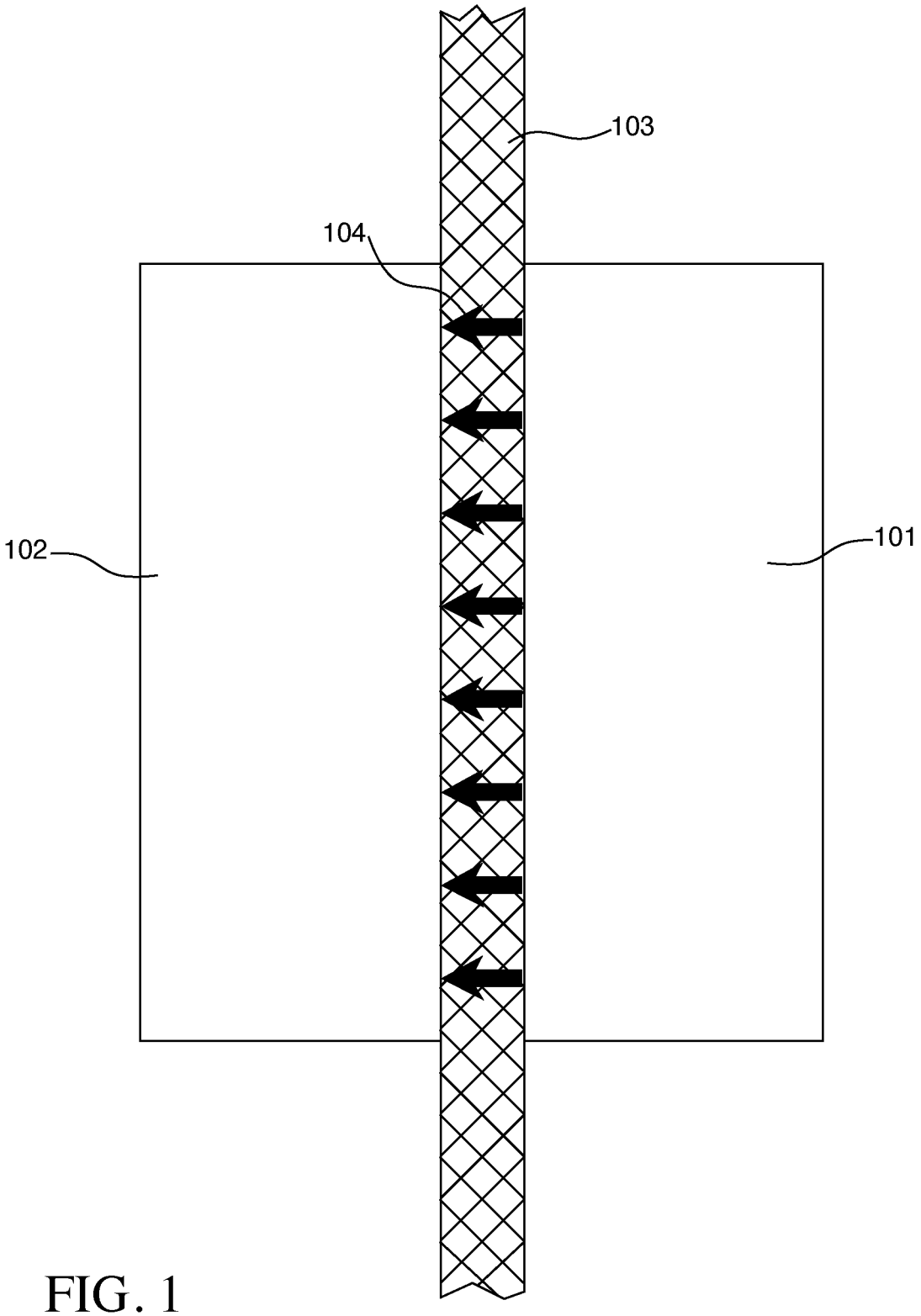

The inventive systems and methods (hereinafter sometimes referred to more simply as "system" or "method") described herein significantly reduce the water, energy, and wear and tear associated with cleaning fabric. Specifically, the system receives a piece of fabric. The system wets the piece of fabric. The system cleans the piece of fabric. The system rinses the piece of fabric. The system dries the piece of fabric. The system steams the piece of fabric. The system sprays deodorant on the piece of fabric. The system includes an emitter header and a suction header, and the piece of fabric is positioned between the two headers.

One or more different embodiments may be described in the present application. Further, for one or more of the embodiments described herein, numerous alternative arrangements may be described; it should be appreciated that these are presented for illustrative purposes only and are not limiting of the embodiments contained herein or the claims presented herein in any way. One or more of the arrangements may be widely applicable to numerous embodiments, as may be readily apparent from the disclosure. In general, arrangements are described in sufficient detail to enable those skilled in the art to practice one or more of the embodiments, and it should be appreciated that other arrangements may be utilized and that structural, logical, software, electrical and other changes may be made without departing from the scope of the embodiments. Particular features of one or more of the embodiments described herein may be described with reference to one or more particular embodiments or figures that form a part of the present disclosure, and in which are shown, by way of illustration, specific arrangements of one or more of the aspects. It should be appreciated, however, that such features are not limited to usage in the one or more particular embodiments or figures with reference to which they are described. The present disclosure is neither a literal description of all arrangements of one or more of the embodiments nor a listing of features of one or more of the embodiments that must be present in all arrangements.

A description of an aspect with several components in communication with each other does not imply that all such components are required. To the contrary, a variety of optional components may be described to illustrate a wide variety of possible embodiments and in order to more fully illustrate one or more embodiments. Similarly, although process steps, method steps, algorithms or the like may be described in a sequential order, such processes, methods and algorithms may generally be configured to work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the embodiments, and does not imply that the illustrated process is preferred. Also, steps are generally described once per aspect, but this does not mean they must occur once, or that they may only occur once each time a process, method, or algorithm is carried out or executed. Some steps may be omitted in some embodiments or some occurrences, or some steps may be executed more than once in a given aspect or occurrence.

When a single device or article is described herein, it will be readily apparent that more than one device or article may be used in place of a single device or article. Similarly, where more than one device or article is described herein, it will be readily apparent that a single device or article may be used in place of the more than one device or article.

The functionality or the features of a device may be alternatively embodied by one or more other devices that are not explicitly described as having such functionality or features. Thus, other embodiments need not include the device itself.

Techniques and mechanisms described or referenced herein will sometimes be described in singular form for clarity. However, it should be appreciated that particular embodiments may include multiple iterations of a technique or multiple instantiations of a mechanism unless noted otherwise. Process descriptions or blocks in figures should be understood as representing modules, segments, or portions of code which include one or more executable instructions for implementing specific logical functions or steps in the process. Alternate implementations are included within the scope of various embodiments in which, for example, functions may be executed out of order from that shown or discussed, including substantially concurrently or in reverse order, depending on the functionality involved, as would be understood by those having ordinary skill in the art.

The following description is of exemplary embodiments of the invention only and is not intended to limit the scope, applicability, or configuration of the invention in any way. Rather, the following description is intended to provide a convenient illustration for implementing various embodiments of the invention. As will become apparent, various changes may be made in the function and arrangement of the elements described in these embodiments without departing from the scope of the invention as outlined in the appended claims.

FIGS. 1 and 2A-E illustrate a system for cleaning and/or maintaining one or more textiles 103 such as cloth, carpet, fabric, or towels. The system includes a first header (emitting component) 101 and a second header (suction component) 102. The first header 101 may be situated parallel to the second header 102 on a cross-sectional plane. The first header 101 may be situated parallel to the second header 102 on a horizontal axial plane. The first header 101 may be situated parallel to the second header 102 on a vertical axial plane. The first header 101 may comprise an outer curve (e.g., arc, etc.) and the second header 102 may comprise an inner curve on a cross-sectional plane. The first header 101 may comprise an outer curve and the second header 102 may comprise an inner curve on a horizontal axial plane. The first header 101 may comprise an outer curve and the second header 102 may comprise an inner curve on a vertical axial plane. The first header 101 may comprise an inner curve and the second header 102 may comprise an outer curve on a cross-sectional plane. The first header 101 may comprise an inner curve and the second header 102 may comprise an outer curve on a horizontal axial plane. The first header 101 may comprise an inner curve and the second header 102 may comprise an outer curve on a vertical axial plane.

The first header 101 may emit a fluid, such as liquid, vapor, dry air or other gas (such as nitrogen, etc.), and/or steam, toward the textile 103. Through the textile 103, the fluid flows in a path 104 to the second header 102. One of the most important advantages of this system is that all excess water is withdrawn by suction in headers 102 instantaneously, thereby avoiding the additional time needed in conventional washing machines for high-speed rotation or squeezing the fabrics. This means time and power savings as well as less wear and tear on clothing articles.

Figure 2A:
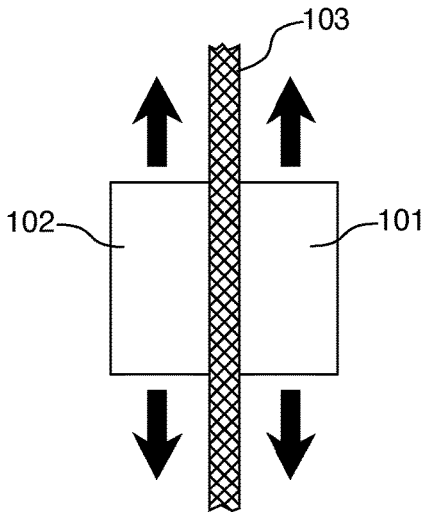
Figure 2B:
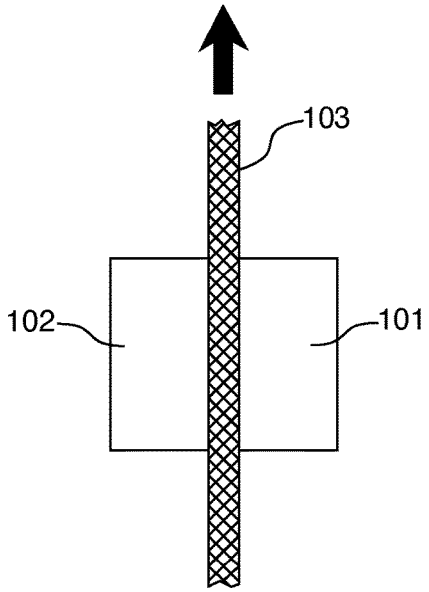
Figure 2C:
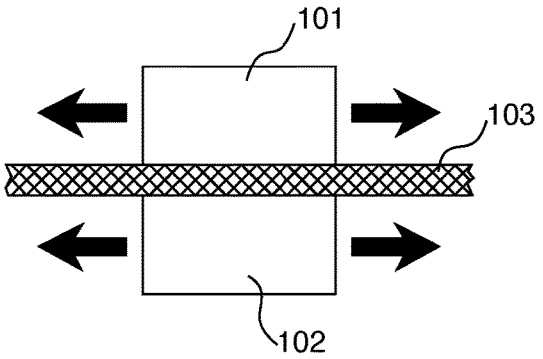
Figure 2D:
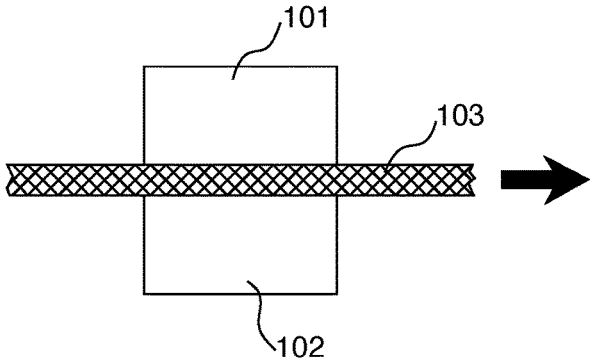
Figure 2E:
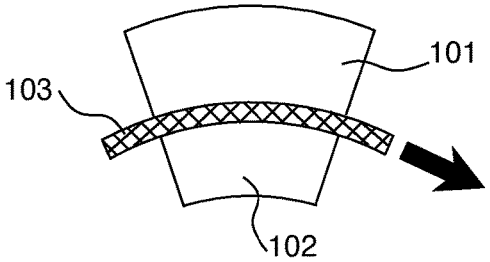

To process the textile 103, the first header 101 and second header 102 may move vertically along the textile 103, as illustrated in FIG. 2A. To process the textile 103, the textile 103 may move vertically between the first header 101 and second header 102, as illustrated in FIG. 2B. To process the textile 103, the first header 101 and second header 102 may move horizontally along the textile 103, as illustrated in FIG. 2C. To process the textile 103, the textile 103 may move horizontally between the first header 101 and second header 102, as illustrated in FIG. 2D. To process the textile 103, the textile 103 may move along a curve between the first header 101 and second header 102, as illustrated in FIG. 2E.

The first header 101 and second header 102 may move along a straight line vertically. The first header 101 and second header 102 may move along a straight line horizontally. The first header 101 and second header 102 may move in one direction. The first header 101 and second header 102 may move in more than one direction. The first header 101 and second header 102 may move along a curved surface, such as on a surface of a cylinder. The textile 103 may move along a straight line vertically. The textile 103 may move along a straight line horizontally. The textile 103 may move in one direction. The textile 103 may move in more than one direction. The textile 103 may move along a curved surface, such as on a surface of a cylinder.

FIGS. 3-6 further illustrate the system for cleaning and/or maintaining the one or more textiles 103. Starting with FIG. 3, the first header 101 includes a conduit 301 for the emitting of detergent solution, dry cleaning liquid, and/or clean water at a desired temperature. The desired temperature may be 5 C.° or greater. The desired temperature may be 100 C.° or less.

The first header 101 further includes a cleaning component 302. The cleaning component 302 may comprise an ultrasonic transducer, a rotating brush, pressurized liquid jets, a mixture of an air-liquid jet, mechanical vibrators, the like, or any combination of the foregoing. The cleaning component 302 may create mechanical vibration, create cavitation, and/or brush the textile 103 to separate and remove dirt particles from the textile fibers.

During the process for cleaning the textile 103, liquid detergent solution and/or dry cleaning liquid may be emitted from the conduit 301 and may flow through the textile 103 to clean and carry out dirt and solid particles toward the second header 102.

The process for cleaning the textile 103 may comprise a rinsing process. During the rinsing process, the first header 101 may emit clean water and/or dry cleaning liquid. The emitted clean water and/or dry cleaning liquid may flow through the textile 103 to wash out the detergent solution or dirty dry cleaning liquid from the cleaning process.

The first header 101 may comprise rollers 303. The rollers 303 may help the first header 101 move smoothly along a surface of the textile 103 and isolate a liquid emitting space to prevent dripping and making a liquid film on the surface of textile 103. The rollers 303 may rotate freely. The rollers 303 may rotate with a motorized actuator.

The first header 101 may comprise isolators 308. The isolators 308 in the first header 101 may isolate a liquid emitting area from the ambient area to prevent liquid leakage. The isolators 308 may be a rubber attachment that provides a water-tight seal between the rollers 303 and the conduit 301 so that fluid emitted by the conduit 301 substantially stays in the area surrounded by the rollers 303 and the conduit 301.

Figure 4:
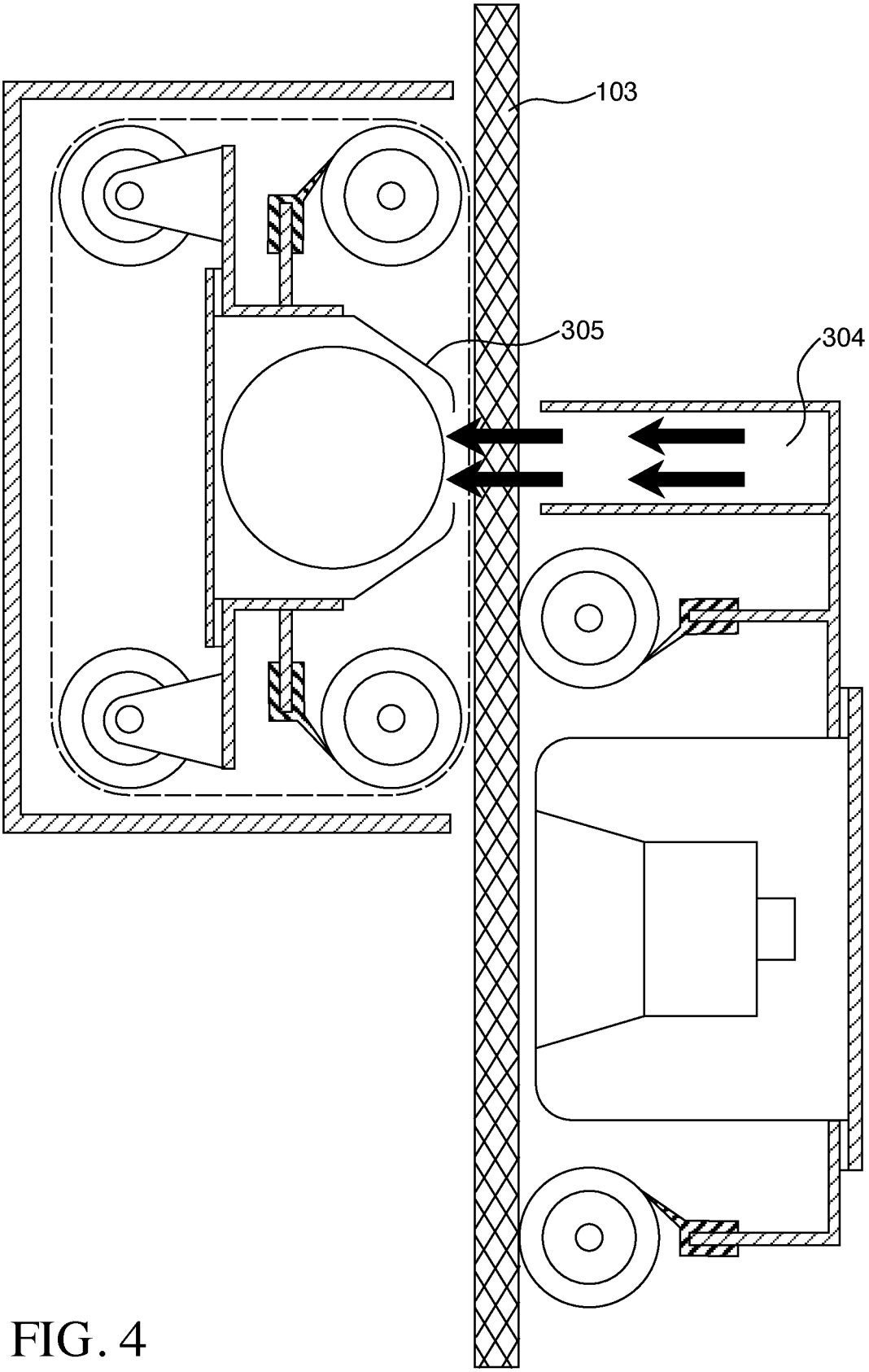
FIG. 4 illustrates a cross-sectional cut view of a system for cleaning fabric in accordance with an exemplary embodiment of the invention.

Turning briefly to FIG. 4, the process for cleaning the textile 103 may comprise a drying process. During the drying process, dry air at a desired drying temperature may flow via the conduit 304 through the textile 103. The desired drying temperature may be in the range of 30 C° to 100 C°. The first header 101 may move in relationship to the second header 102 such that the conduit 304 of the first header 101 is lined up with a suction nozzle 305 of the second header 102. With the aid of an electrical actuator it is possible to change the headers' position relative to each other. In other embodiments, the air and water emission conduits are the same and thus, changing the relative positions of the headers is unnecessary.

Turning back to FIG. 3, the second header 102 includes the suction nozzle 305, a suction conduit 307, front conveyor rollers 309, back conveyor rollers 310, and a perforated or screen conveyor 306. The second header 102 may suction in liquid, wet air, and/or steam emitted by the first header 101. The perforated or screen conveyor 306 may prevent the textile 103 from sticking to the suction nozzle 305. Without the perforated or screen conveyor 306, the textile 103 may stick to the suction nozzle 305 due to a pressure difference of suction pressure and ambient pressure.

The suction nozzle 305 may comprise a path to allow liquid, wet air, and/or steam emitted by the first header 101 to flow to the suction conduit 307. The suction conduit 307 may suck liquid, wet air, and/or steam emitted by the first header 101 that has passed through the textile 103.

The front conveyor rollers 309 and/or the back conveyor rollers 310 may help the second header 102 move smoothly along a surface of the textile 103 and isolate a suction space to prevent dripping and making a liquid film on the surface of textile 103. The front conveyor rollers 309 and/or the back conveyor rollers 310 may rotate freely. The front conveyor rollers 309 and/or the back conveyor rollers 310 may rotate with a motorized actuator.

The isolators 308 in the second header 102 may isolate a low-pressure suction area from the ambient area to prevent air leakage.

Figure 3:
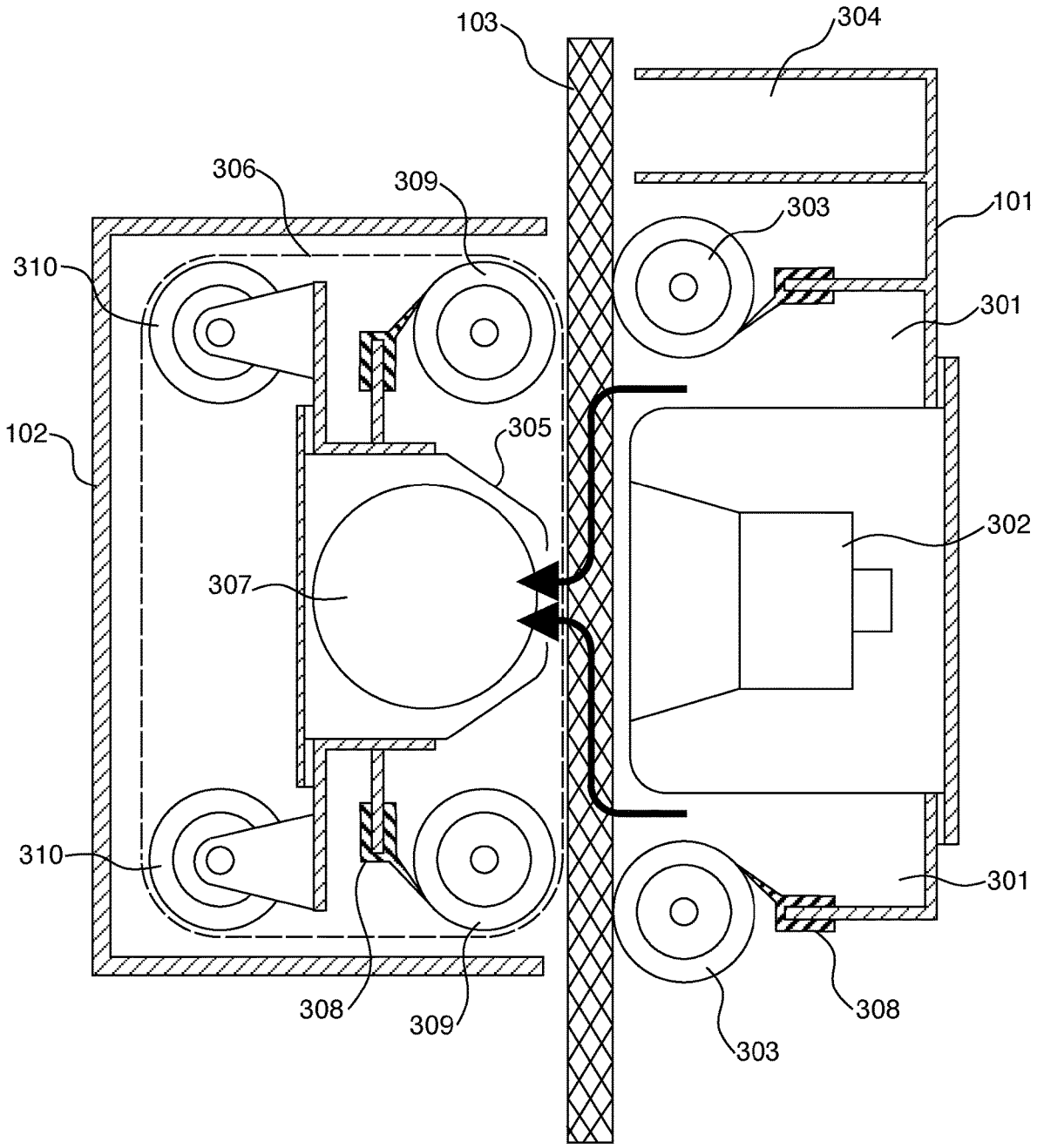
FIG. 3 illustrates a cross-sectional cut view of a system for cleaning fabric in accordance with an exemplary embodiment of the invention.
Figure 5:
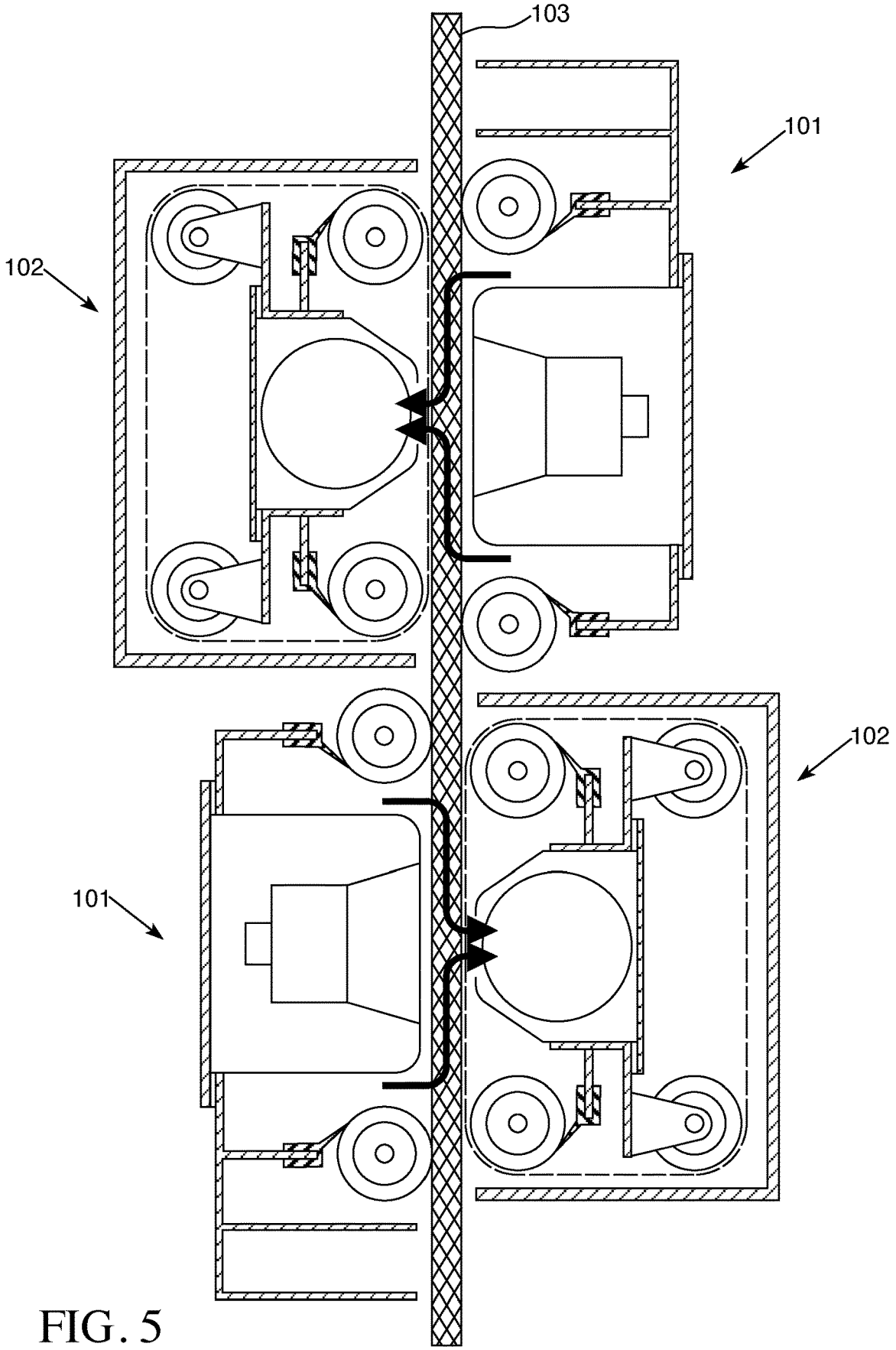
FIG. 5 illustrates a cross-sectional cut view of a system for cleaning fabric in accordance with an exemplary embodiment of the invention.

Turning to FIG. 5, the flow of liquid and gas shown in FIG. 3 may be on one side of the textile 103 to the other side and vice versa simultaneously with conjugating of first headers 101 with opposing second headers 102. The system in FIG. 5 includes an emitting header 101 positioned on each side of the textile 103 and a suction header 102 aligned with each emitting header 101.

Figure 6:
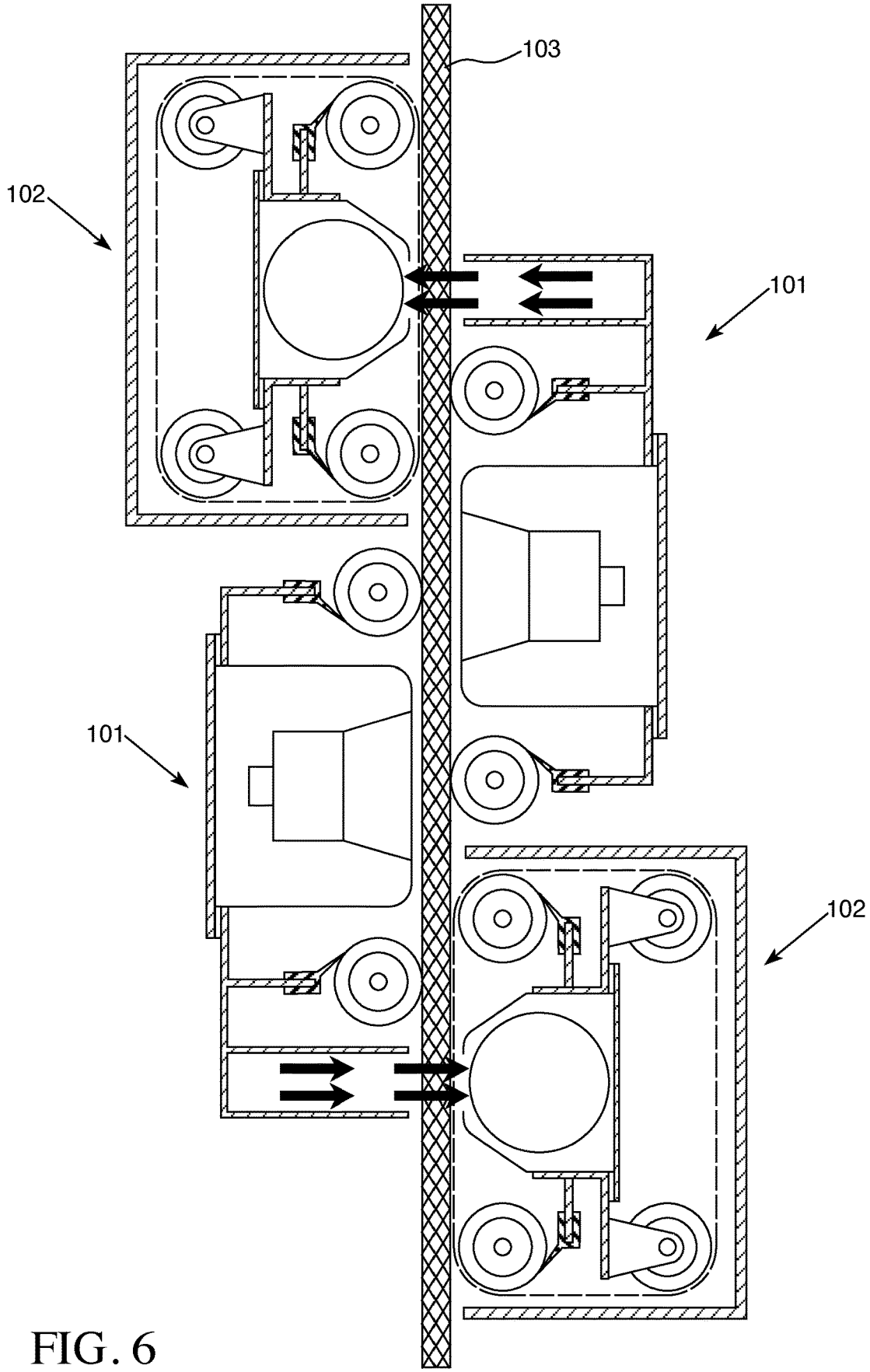
FIG. 6 illustrates a cross-sectional cut view of a system for cleaning fabric in accordance with an exemplary embodiment of the invention.

Turning to FIG. 6, the flow of gas shown in FIG. 4 may be on one side of the textile 103 to the other side and vice versa simultaneously with conjugating of first headers 101 with opposing second headers 102. The first headers 101 and the second headers 102 in FIG. 5 may be relocated to a position shown in FIG. 6 for the drying process.

The emitting headers 101 and suction headers 102 may be coupled to a chassis to keep them aligned with each other. Positioning of the headers 101, 102 relative to each other and to the textile 103 may have many different configurations, some of which are described below with reference to FIGS. 7A-12.

Figure 7A:
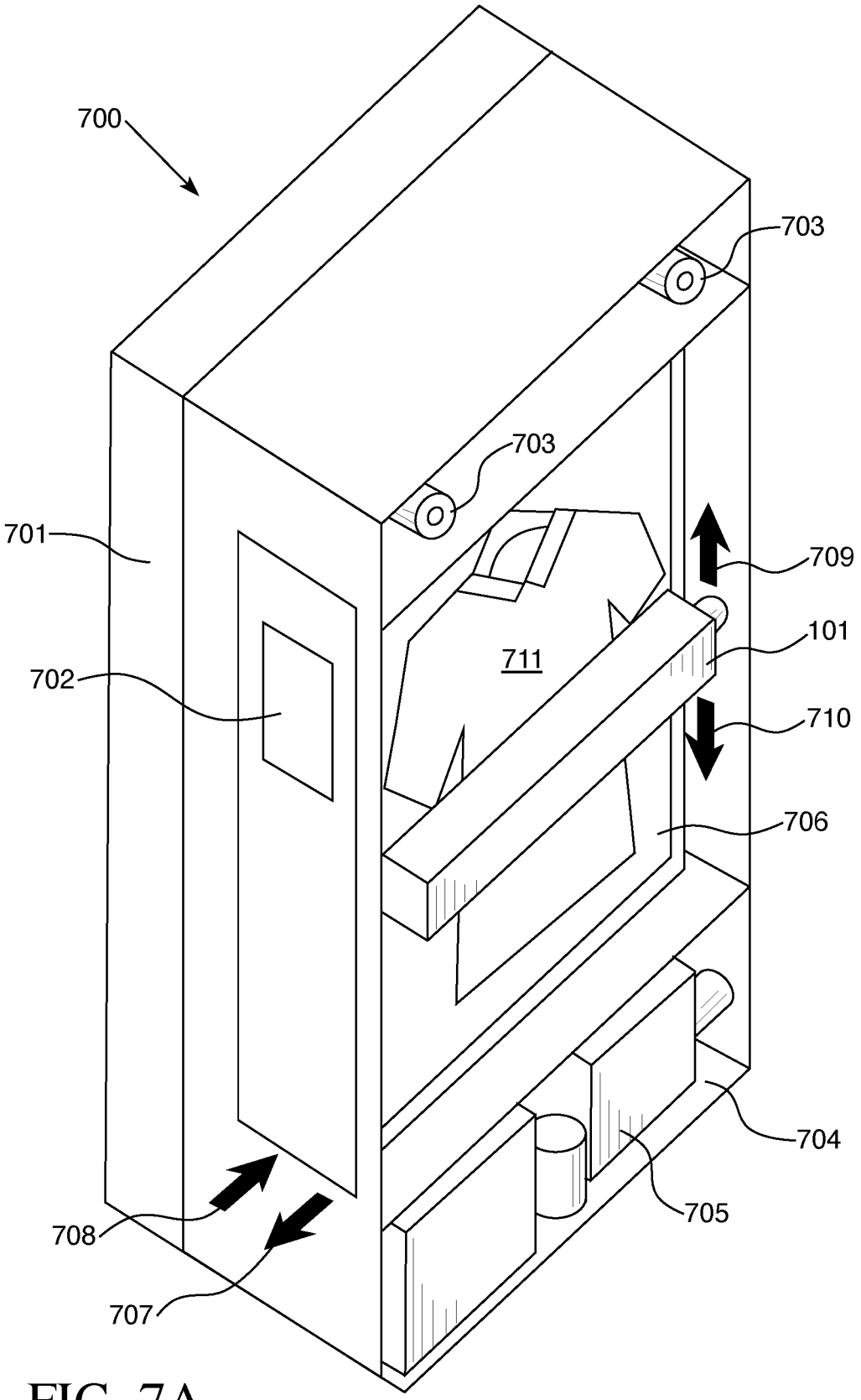
FIGS. 7A and 7B illustrate perspective views of a system for cleaning fabric in accordance with an exemplary embodiment of the invention.
Figure 7B:
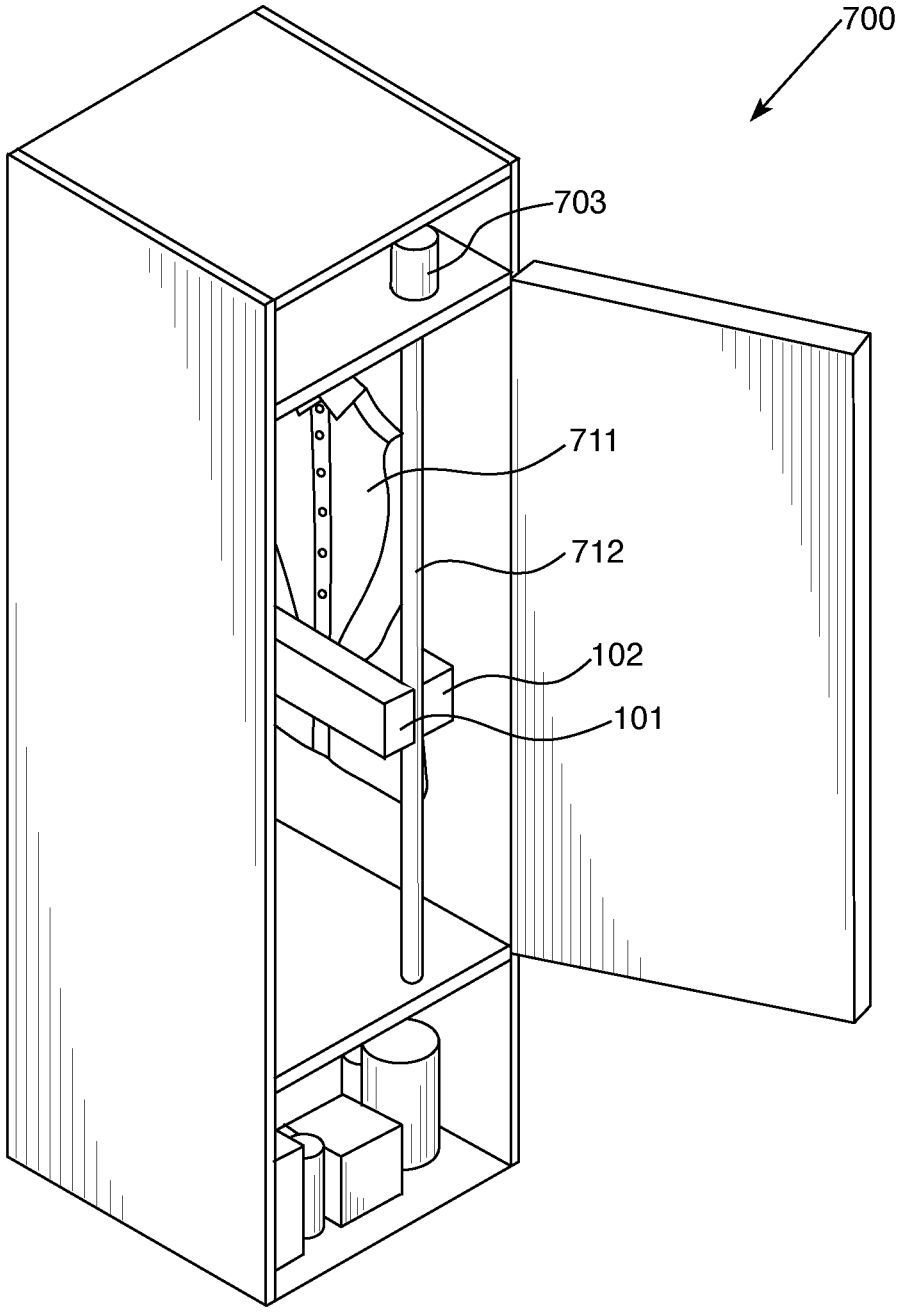

FIG. 7A shows a washing appliance 700 in accordance with the systems and methods described herein. The washing appliance 700 depicted in FIG. 7B is substantially similar to that depicted in FIG. 7A. The washing appliance 700 may be appropriate for use in an individual home, for example. In addition to the components discussed above, the washing appliance 700 may comprise a detergent compartment 701, a control system monitor 702, one or more servo motors 703, one or more pumps 704, a water compartment 705, and a screen 706. An article of clothing 711 may be in the washing appliance 700. The article of clothing 711 may be similar to the textile 103 depicted in FIGS. 1-6. The detergent compartment 701 may comprise detergent and/or dry cleaning liquid. The control system monitor 702 may allow a user to control other components of the washing appliance 700 and/or provide feedback regarding operation of other components of the washing appliance 700 to the user. Engagement with the control system monitor 702 may cause a portion of the washing appliance 700 holding the article of clothing 711 to move to the left 707 or the right 708. The one or more servo motors 703 may cause the first header 101 and/or the second header 102 to move vertically up 709 or vertically down 710. The water compartment 705 may comprise water. The one or more pumps 704 may cause water to move from the water compartment 705 to the first header 101. The screen 706 may be situated between the first header 101 and the article of clothing 711. The appliance 700 further includes another screen (not shown) between the suction header 102 and the article of clothing 711.

A distance between the headers 101, 102 is sufficient for accommodating the article of clothing 711 therebetween. For example, the distance between the headers 101, 102 may be about 0-50 mm. The headers 101, 102 may be configured to move towards each other and away from each other. For example, during a pressing or ironing procedure, the headers 101, 102 are moved towards each other so that the article of clothing 711 is pressed snugly between them.

The emitting header 101 and suction header 102 may be mounted on a chassis that may be configured to move horizontally and/or vertically. For example, the chassis may be coupled to a rotating guide screw 712 (shown in FIG. 7B). However, the invention is not limited to the rotating guide screw 712 and the chassis may alternatively be coupled to a timing pulley and belt, a winch system, or the like. Two or more rails and sliding guides conduct the chassis. At the start position, the chassis may be located at the lower bottom position under the article of clothing 711 on the hanger. During the washing, rinsing, drying and steaming processes the chassis moves up to locate the textile 711 between the two headers 101, 102. The forced rotating rollers 309 and 303 (shown in FIG. 3) on both sides of the textile 711 draw the textile 711 between the emitting header 101 and the suction header 102. The home appliance system 700 may have two or more sets of headers 101, 102 that work simultaneously.

The washing appliance 700 may be applicable for a textile or garment hanging on a hanger, such as the garment 711. In this embodiment, the garment 711 remains stationary and the first header 101 and the second header 102 move along the garment 711 to treat the entirety of the garment 711.

The washing appliance 700 is a revolutionary wardrobe type washing machine with the capability of wet and dry laundry, drying, steaming, and aromatizing of a textile with minimum possible water and power consumption in comparison with the conventional front and top-loading washing machine. Another advantage of the washing appliance 700 is that it prevents or reduces textile and fabric damage due to mechanical scrubbing in comparison with conventional washing machines that work by tumbling the fabric.

Figure 8:
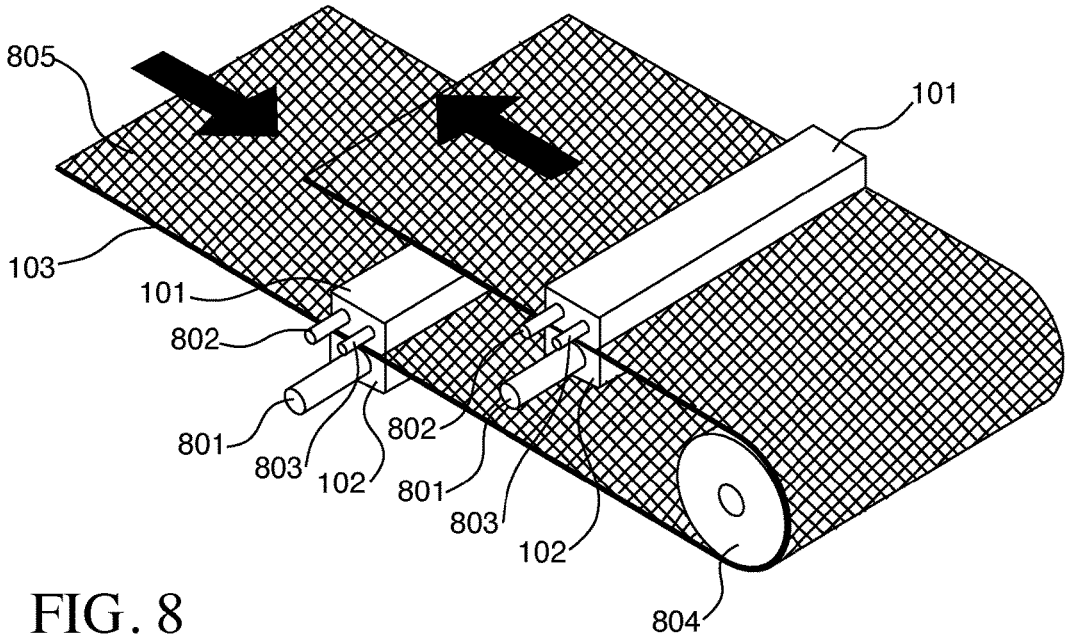
FIG. 8 illustrates a perspective view of a system for cleaning fabric in accordance with an exemplary embodiment of the invention.

FIG. 8 depicts an embodiment for an industrial continuous washing machine 800. Unlike the previous embodiments, in this embodiment, first headers (emitting components) 101 and second headers (suction components) 102 may be fixed and the textile 103 may move. First headers 101 may be installed on the top surface of the textile 103. Second headers 102 may be installed on the bottom surface of the textile 103. Both sides of the textile 103 may be washed simultaneously. The first headers 101 may comprise a first inlet conduit 802 for dry air or gas and/or steam and a second inlet conduit 803 for clean water, dry cleaning agent or detergent solution or other chemical solution (such as bleaching agent, stain removers, etc.) emission. The second headers 102 may comprise a suction conduit 801 to suck the dirt solution and/or wet gas or steam from the textile or fabric body. Each of the first headers 101 may be affixed to a position opposite to a particular second header 102 so that the headers 101, 102 remain aligned with each other. A roller 804 may be used to move the textile 103. Two screens or perforated conveyor belts 805 may be used to hold the textile 103 therebetween.

Figure 9:
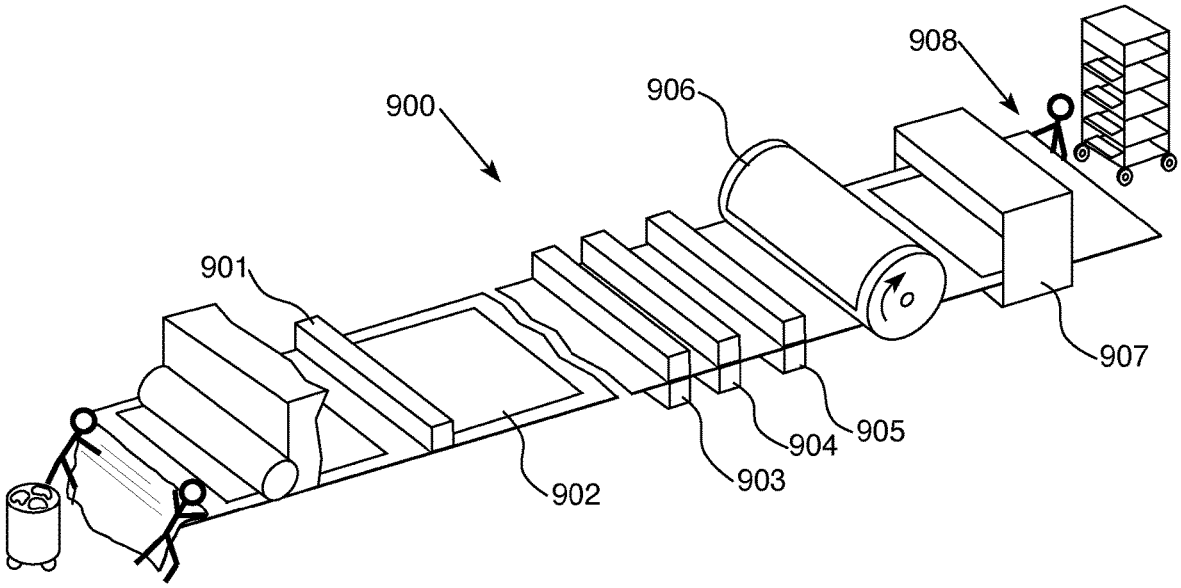
FIG. 9 illustrates a perspective view of a system for cleaning fabric in accordance with an exemplary embodiment of the invention.

Turning to FIG. 9, another embodiment for an industrial continuous washing machine 900 is illustrated. The washing machine 900 may comprise a detergent solution wetting header pair 901, a soaking area 902, a cleaning header pair 903, a rinsing header pair 904, a drying header pair 905, a steam iron 906, a folding machine 907, and a collection area 908. One or more workers may load a textile, such as sheets, into the washing machine 900. The detergent solution wetting header pair 901, the cleaning header pair 903, the rinsing header pair 904, and/or the drying header pair 905 may each include an emitting header 101 and a suction header 102, such as those described above.

The textile loaded into the washing machine 900 may be wet with detergent solution by the detergent solution wetting header pair 901. After being wet by the detergent solution wetting header pair 901, the wet textile may enter the soaking area 902. The wet textile may stay in the soaking area 902 for a predetermined amount of time. After leaving the soaking area 902, the textile may be cleaned by the cleaning header pair 903. After being cleaned, the textile may be rinsed by the rinsing header pair 904. After being rinsed, the textile may be dried by the drying header pair 905. After being dried, the textile may be ironed by the steam iron 906. After being ironed, the textile may be folded by the folding machine 907. After being folded, the textile may be stored in the collection area 908.

Figure 10:
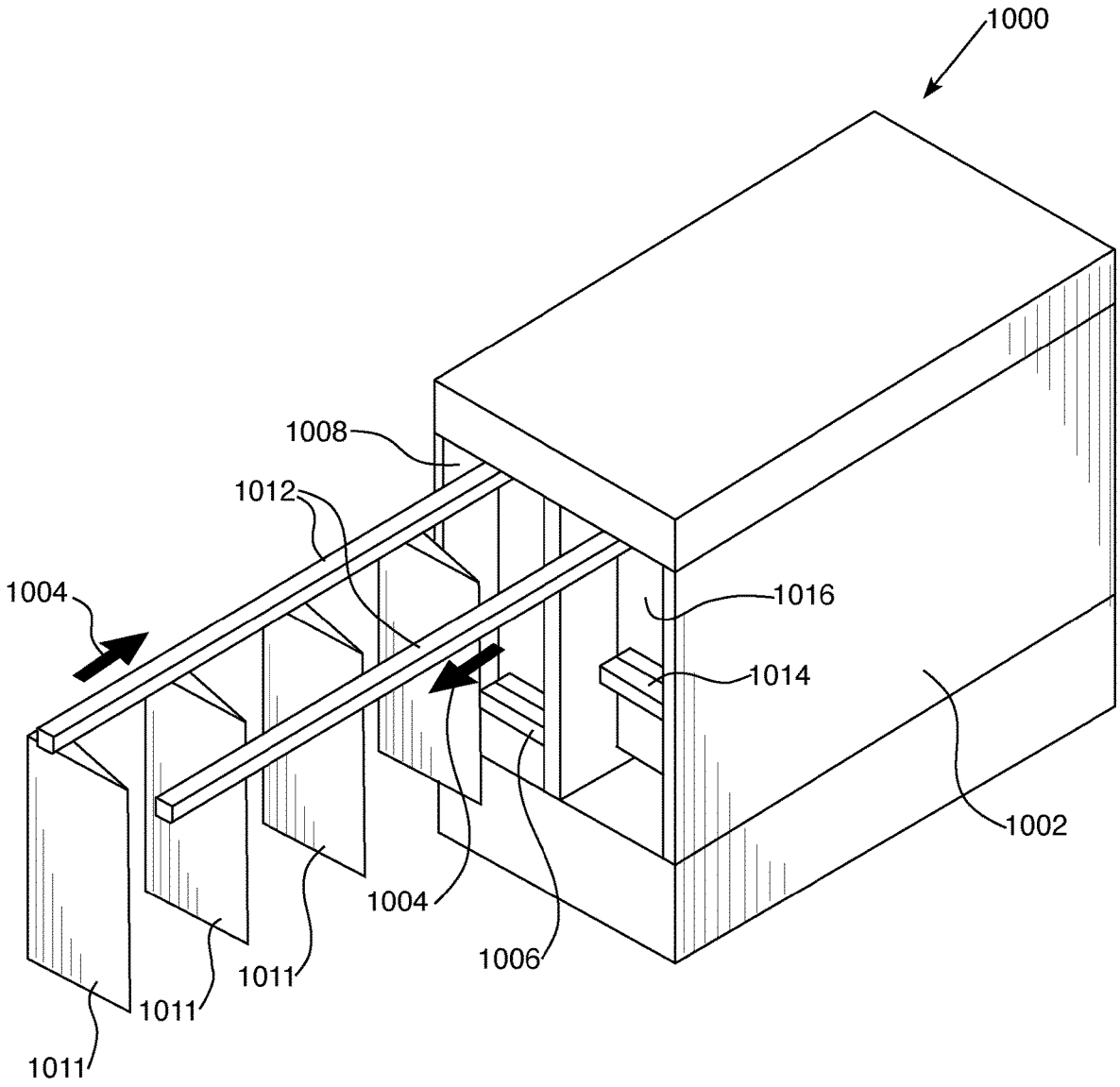
FIG. 10 illustrates a perspective view of a system for cleaning fabric in accordance with an exemplary embodiment of the invention

An embodiment of a professional washing system 1000 is depicted in FIG. 10. The system 1000 is configured to clean several articles of clothing 1011 in a quick, efficient, continuous manner. The articles of clothing 1011 hang from a conveyor 1012 configured for moving the clothing items 1011 through a washing and drying tunnel 1002. The garment moving direction is indicated by arrows 1004.

The system 1000 may have a plurality of emitting headers 101 and suction headers 102 to increase the performance and capacity of the cleaning process. The number of headers depends on the capacity of the washing system. For example, one or more sets of headers 101, 102 may be configured to wash the clothing, another set may be configured to rinse the washed clothing, yet another set may be configured to dry the clothing, and yet another set may be configured to treat the clothing with aromatizing agents. Washing headers, rinsing headers and drying headers are located one after another respectively. For example, as depicted in FIG. 10, a set of headers 1006 configured to wash the clothing is located adjacent to the entrance 1008 of the system 1000. A set of headers 1014 configured to dry the clothing is located adjacent to the exit 1016 of the system 1000. Each set of headers 101, 102 may be installed on a chassis that is elevated by a jack. The jack may be an X type jack with a motorized actuator. For example, a screw in a screw and nut guide may be rotated by an electrical motor while the nut is fixed to another leg of the X jack. Alternatively or additionally, the actuator may be a simple hydraulic or pneumatic jack. The elevating system may include a cylindrical jack (e.g., pneumatic, hydraulic or electrical) or some kind of timing belt, chain and gear, or winch system. For example, a cylindrical jack may be used directly with one side of the jack fixed to the structure and the other side configured to move the chassis up and down. Any one or a combination of these types of jacks may be used in the elevating system.

Figure 11A:
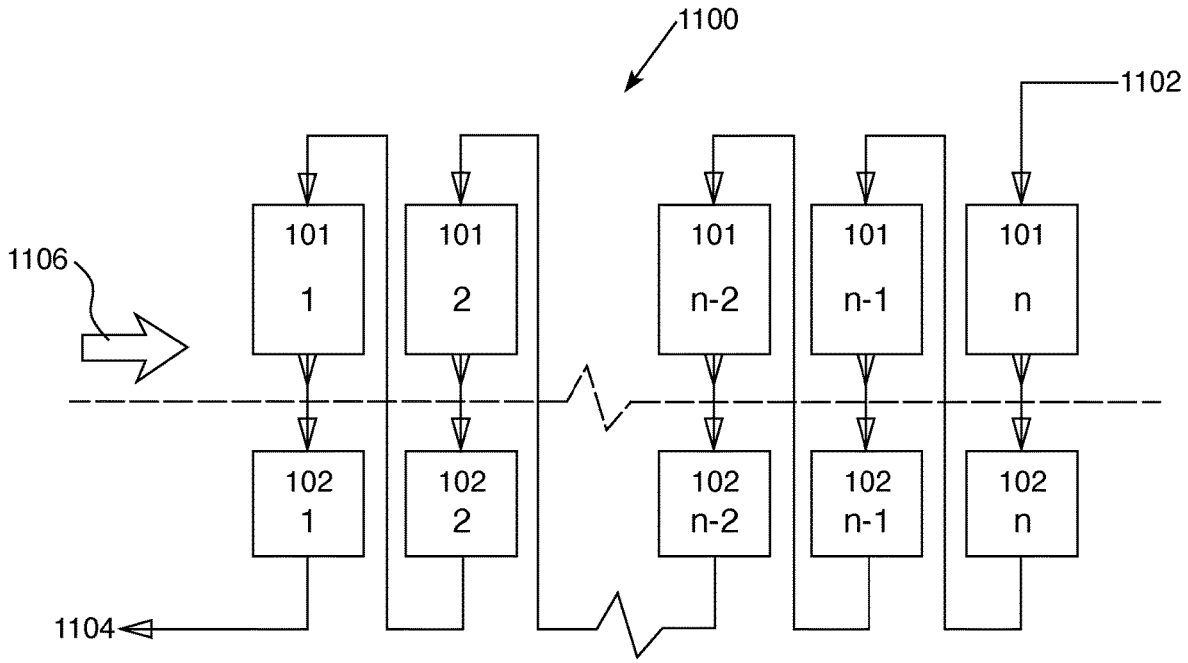
FIGS. 11A and 11B are flowcharts illustrating the flow of detergent solution and clean water, respectively, relative to the movement direction of the fabric being clean in accordance with an exemplary embodiment of the invention.
Figure 11B:
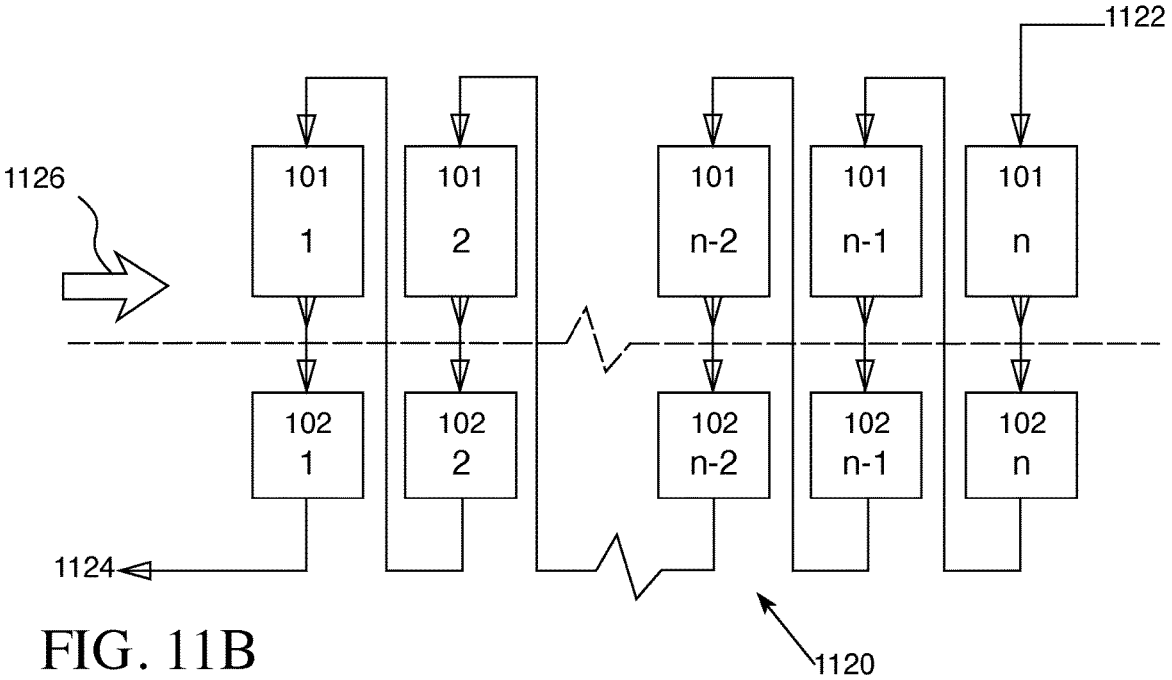

An industrial scale system is similar to the professional system 1000. One difference between the two is the capacity and the length of the tunnel. Both professional and industrial systems may operate in accordance with the flow diagrams depicted in FIGS. 11A and 11B. FIG. 11A depicts a flow diagram for detergent, while FIG. 11B depicts a similar flow diagram for clean water. It will be readily understood that other zones of the system, such as drying gas (e.g., air, nitrogen, or the like), aromatizing agents, etc, will operate similarly in accordance with the flow diagrams shown in FIGS. 11A and 11B.

FIG. 11A depicts a series 1100 of washing header pairs 1, 2 . . . n-2, n-1, n. The fresh detergent solution enters emitting header 101(*n*) at the entrance 1102, and the effluent from suction header 102(*n*) enters emitting header 101(*n*-1). The effluent of suction header 102(*n*-1) enters emitting header 101(*n*-2), and so forth until the first suction header 102(1). The effluent from suction header 102(1) exits the system at 1104. Meanwhile, the articles of clothing move through the system 1100 starting at header pair 1 and exiting at header pair n, as shown by arrow 1106. This kind of header arrangement increases the washing efficiency and decreases the detergent, water, and power consumption in comparison with a conventional washing chamber with tumbling movement.

The flow diagram 1120 depicted in FIG. 11B is substantially similar to that shown in FIG. 11A, except that the pairs of headers 1, 2 . . . n-2, n-1, n are configured for rinsing the articles of clothing. Instead of a detergent, water flows through the headers 1, 2, n-2, n-1, n and the fabric media. Clean water enters the last emitting header 101(*n*) at the inlet 1122 and the outlet of each suction header 102 enters to the emitting header 101 of the previous pair. As illustrated in FIG. 11B, the clear and clean water enters the emitting header 101(*n*) and the effluent from the suction header 102(*n*) enters the emitting header 101(*n*-1), the effluent from suction header 102(*n*-1) enters to the emitting header 101 (*n*-2), and so forth, until the first pair of headers. The effluent from the first suction header 102(1) exits the system at 1124.

The liquid flow direction in both washing and rinsing zones in FIGS. 11A and 11B, respectively, are countercurrent to the direction of movement of the articles of clothing, which is depicted by arrows 1106 and 1126, respectively. This flow arrangement is the most efficient process that causes minimum water and detergent consumption. This design maximizes the washing and rinsing efficiency so the liquid temperature can be at room temperature. This means the power and fuel consumption may be lower than the conventional tumbling washing chamber.

Figure 12:
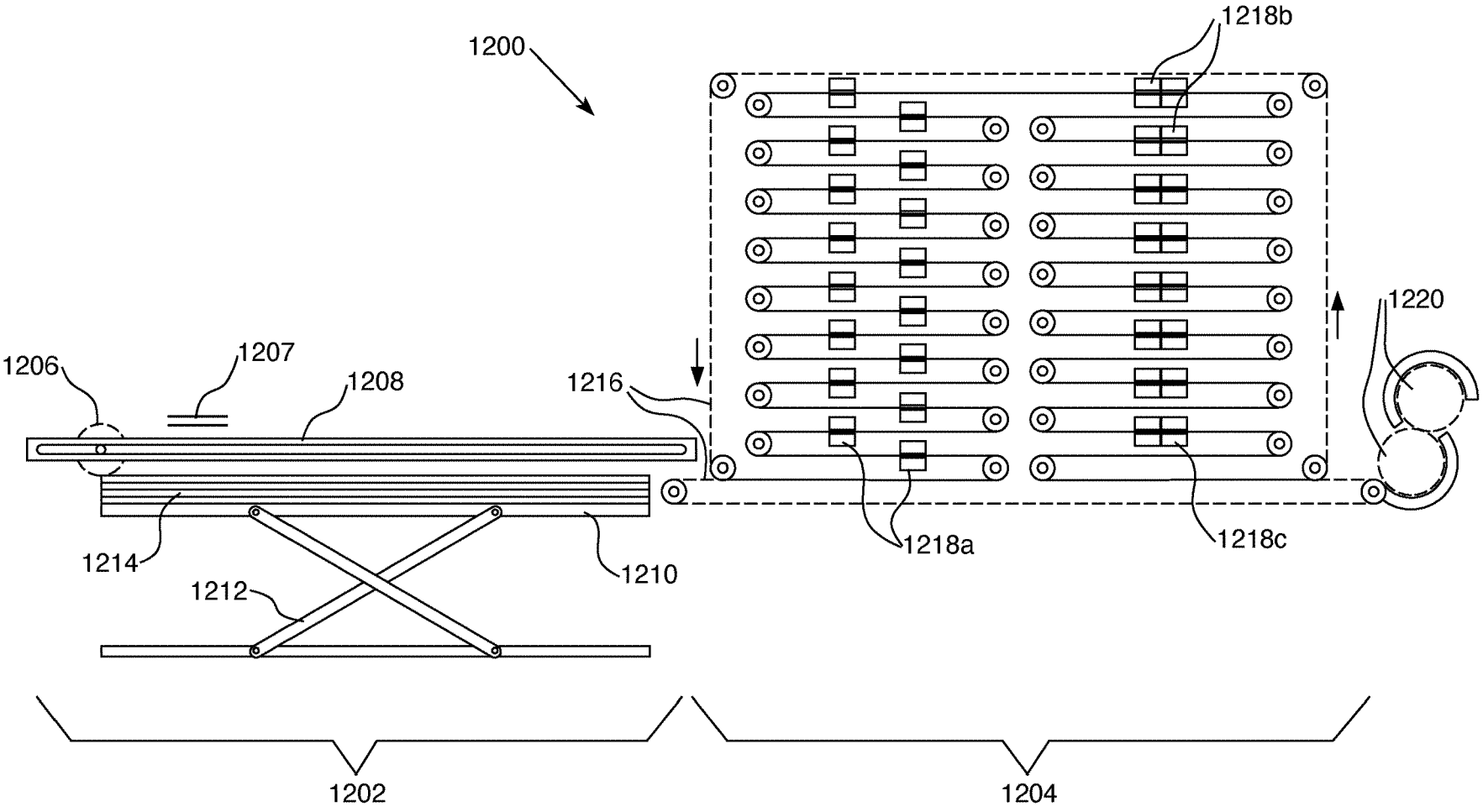
FIG. 12 is a side view of an industrial system for cleaning fabric in accordance with an exemplary embodiment of the invention.

An embodiment of a flat sheet industrial system 1200 is shown in FIG. 12. The system 1200 includes two sections. In particular, the system 1200 includes a feeding section 1202 and a washing, drying and ironing section 1204. The process starts with spreading the flat sheets on a perforated rotating cylindrical roller 1206 of the feeding section 1202. Inside the roller 1206 is vacuumed so the fabric sheet sticks on the roller 1206. By the roller rotation, the fabric sheet is wrapped on the cylindrical roller 1206. After completion of the sheet wrapping, the roller 1206 moves on the guide rail 1208 to locate on the desk 1210, then the roller rotation changes to the opposite direction while moving along the guide rail 1208 simultaneously to spread the sheet on the desk 1210. The direction of movement of the roller 1206 along the guide rail 1208 is indicated by arrows 1207. There are some nozzles to spray the detergent solution on the sheet to wet and soak them. This process repeats for the next sheet. The desk 1210 is elevated by an X type jack 1212 automatically. This process repeats until all sheets are collected on the desk 1210.

After the collection, the washing section loading process is started automatically. During the loading process, the feeder roller 1206 rotates to wrap the sheets around itself and releases them on a screen conveyor 1216 one by one. The screen conveyor 1216 includes two layers, and the fabric is positioned between them. The fabric is dragged into the washing, drying, and ironing section by conveyor movement. The fabric passes between a plurality of stationary header pairs 1218*a*, 1218*b*, 1218*c*. Some of the header pairs 1218*a* are configured for washing the fabric, other header pairs 1218*b* are configured for rinsing, and still other header pairs 1218*c* are configured for drying the fabric. The fabric is then passed through rotating ironing drums 1220 near the exit of the washing, drying, and ironing section 1204.

Thus, there are two mechanisms for retaining the position of the fabric between the headers 101, 102. The first mechanism is two parallel perforated rotating rollers or cylinders, and the second mechanism is two adjacent screen conveyors, such as screen conveyors 1216. Two headers are forced towards each other by a pair of springs or by the decentered gravity center.

As mentioned above, in some systems (such as the system 700 shown in FIGS. 7A and 7B), the clothing is static and headers move vertically along the clothing during the cleaning process. The headers may then move horizontally at the bottom level to clean other clothing articles. The headers are fixed on a chassis that is configured to move in the X and Z directions by aid of a mechanism such as an x/y CNC machine. After cleaning one article of clothing, the headers return to the lowest position under the hanging clothing article and then move horizontally to a position under the next article of clothing. In some systems, the headers only move vertically along the clothing. In other systems, such as those depicted in FIGS. 8, 9, and 12, clothing moves horizontally from one pair of headers to another pair of headers. In these systems, the headers are static and the fabric moves between them.

Figure 13:
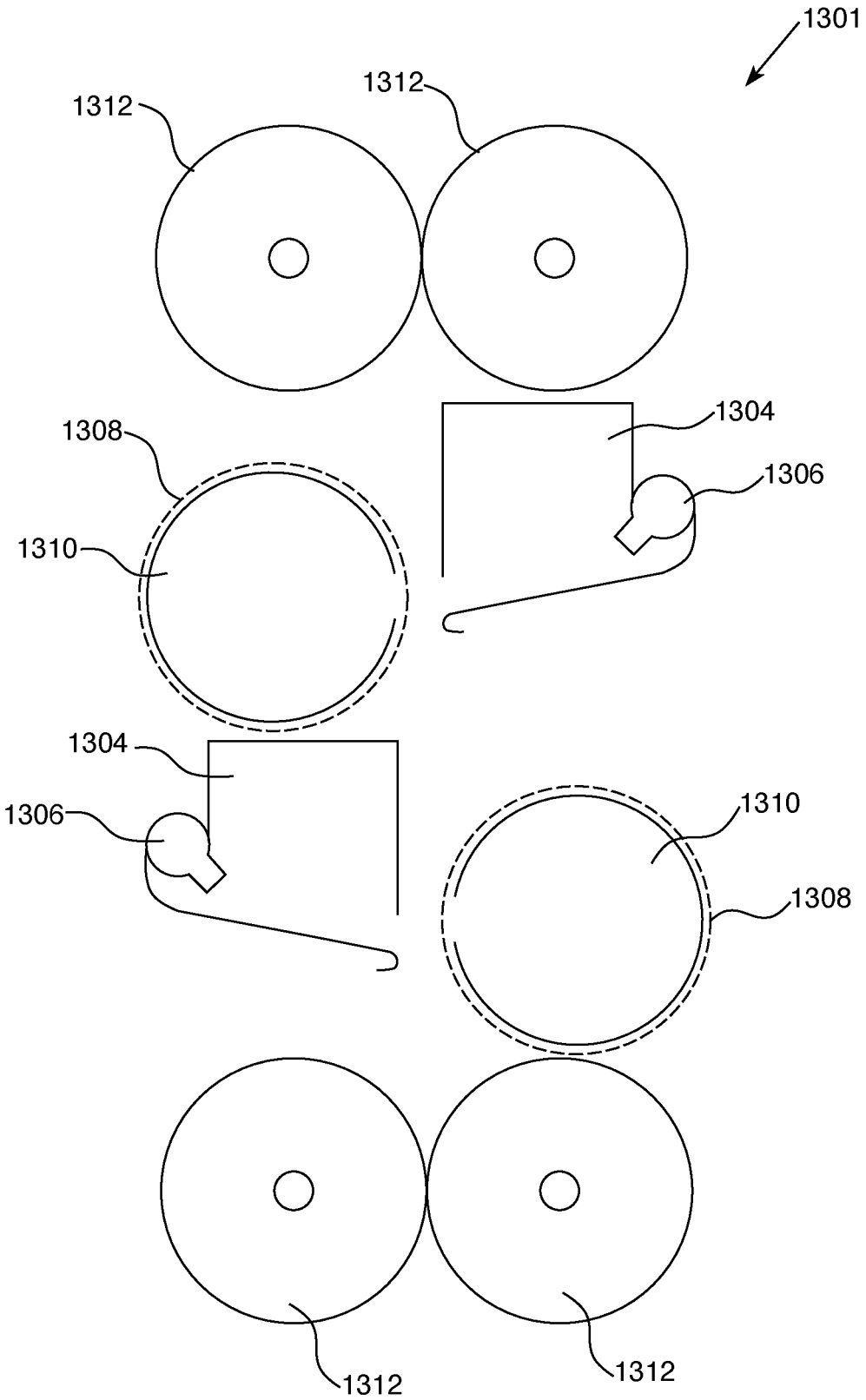
FIG. 13 is a schematic view of an emitting header and a suction header in accordance with an exemplary embodiment of the invention.

FIG. 13 shows an example of emitting and suction headers having the air and liquid conduits and nozzles in the same location so that changing the relative position of the headers is not necessary. In particular, FIG. 13 is a schematic diagram of a pair of headers 1301, 1302 that are configured to remain aligned with each other. That is, the headers 1301, 1302 do not move relative to each other. In this embodiment, each one of the headers 1301, 1302 includes an air conduit 1304, liquid pipe and nozzle 1306, and a perforated rotating cylinder 1308 aligned with the air conduit 1304 and liquid nozzle 1306 in the opposite header 1302, 1301, respectively. The rotating cylinder 1308 includes a vacuum conduit 1310 through the center thereof and a screen or mesh roller cover to prevent the clothing or fabric from sticking to the roller 1308. Air or liquid emitted through the air conduit 1304 or liquid nozzle in header 1301 is suctioned by the rotating vacuum cylinder 1308 in header 1302. Similarly, air or liquid emitted through the air conduit 1304 or liquid nozzle in header 1302 is suctioned by the rotating vacuum cylinder 1308 in header 1301. In this manner, both sides of the clothing or fabric are cleaned. The headers 1301, 1302 further include rotating rollers 1312 for moving the headers 1301, 1302 relative to fabric articles disposed between the headers 1301, 1302. This embodiment is advantageous because the rotating screen cylinders 1308 provide mechanical simplicity that extends the life of the headers 1301, 1302. In addition, the jet nozzles in this embodiment provide greater impact on the clothing or fabric, which improves the ability to remove dirt and soil from the clothing or fabric.

Figure 14:
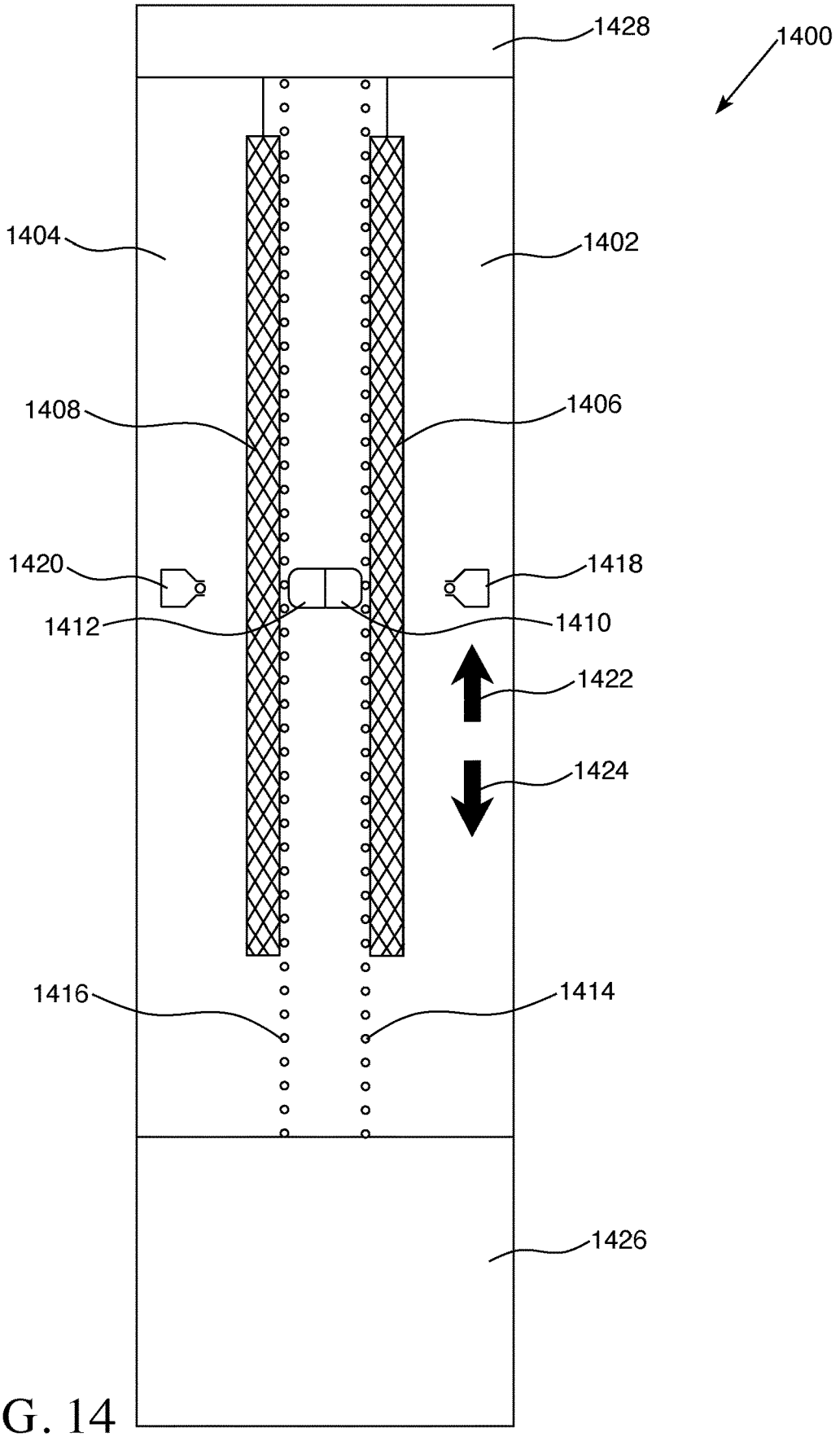
FIG. 14 is a cross-sectional view of a system for cleaning fabric in accordance with an exemplary embodiment of the invention.

FIG. 14 illustrates a fabric cleaning apparatus 1400 having two washing compartments 1402, 1404 for cleaning two fabric articles 1406, 1408 at the same time. The apparatus 1400 includes suction headers 1410, 1412 positioned between the two washing compartments 1402, 1404 with screen dividers 1414, 1416 disposed between the suction headers 1410, 1412 and the fabric articles 1406, 1408. The apparatus 1400 further includes emitting headers 1418, 1420 positioned on the other side of the fabric articles 1406, 1408 aligned with the suction headers 1410, 1412. During operation of the apparatus 1400, the fabric articles 1406, 1408 remain in place and the headers 1410, 1412, 1418, 1420 move up and down along the fabric articles, as shown by arrows 1422, 1424. The apparatus 1400 includes a bottom compartment 1426 that houses components related to the water, detergents, air, and steam, such as suction motors, water pumps, water vessels, and the like. An upper compartment 1428 houses components related to the mechanism for moving the headers 1410, 1412, 1418, 1420, such as servo motors, control system integrated circuits, and the like.

Figure 15:
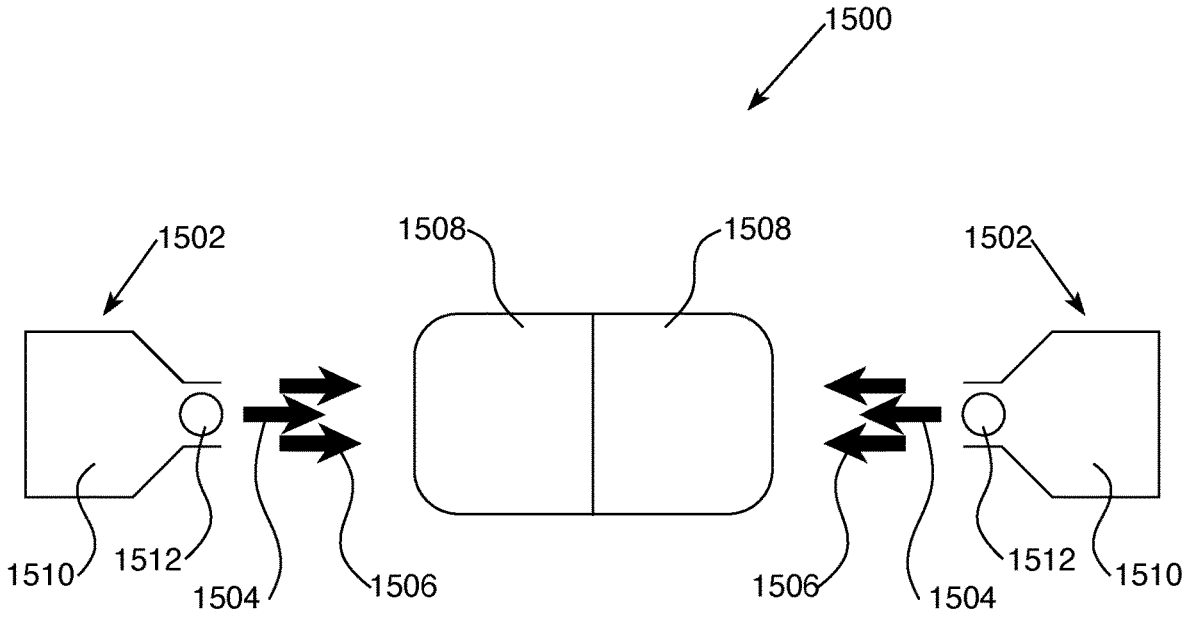
FIG. 15 is a schematic view of emitting headers and suction headers in accordance with an exemplary embodiment of the invention.

In yet another header configuration 1500, shown in FIG. 15, the emitting headers 1502 emit liquid and air at the same time so that the liquid flow, shown by arrows 1504, is surrounded by air flow, shown by arrows 1506. In this manner, the liquid flow 1504 can be precisely directed at a fabric article (not shown) disposed between the emitting headers 1502 and the suction headers 1508. The emitting headers 1502 each include an air conduit 1510 and a liquid conduit 1512. By more precisely directing the liquid flow 1504, this header configuration 1500 increases the force exerted on the fabric articles by the liquid, thereby increasing the efficiency and efficacy of the washing machine having this header configuration 1500.

Figure 16:
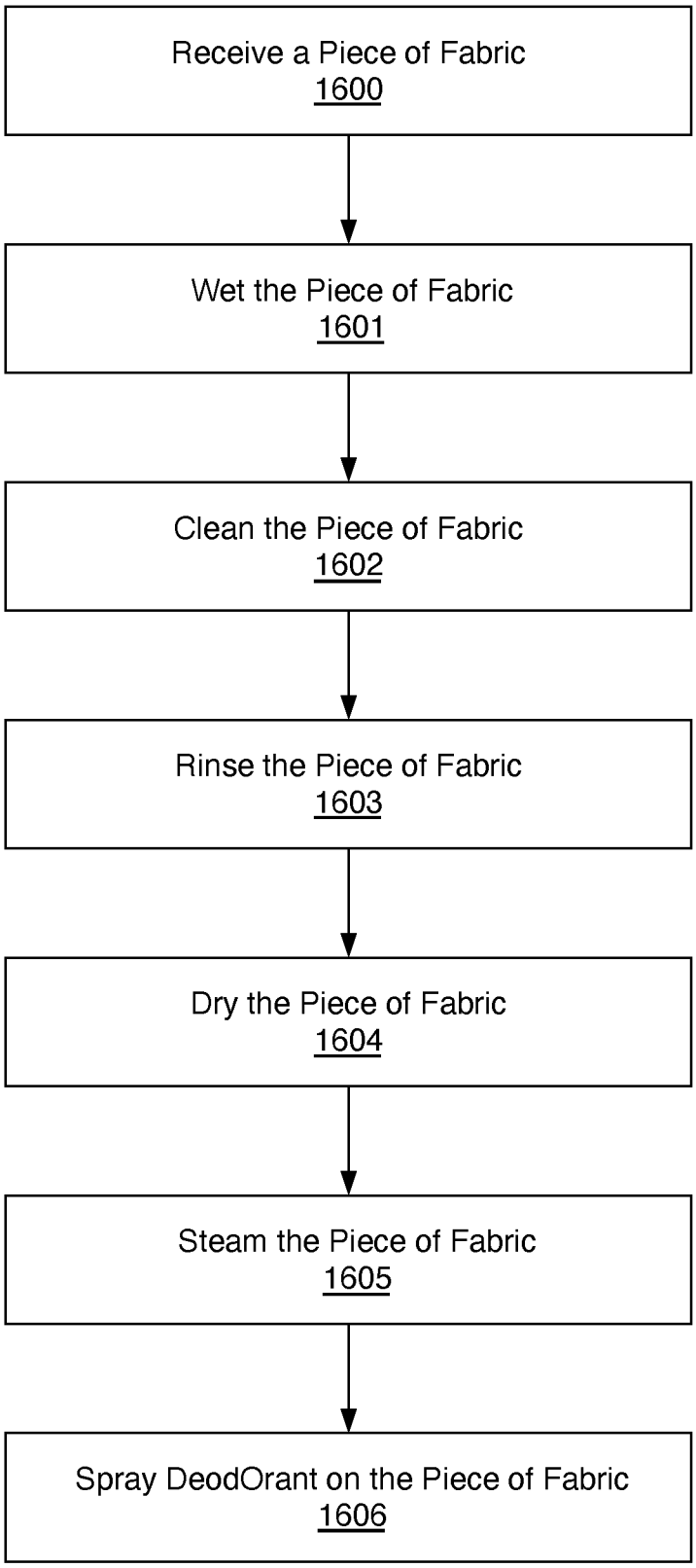
FIG. 16 is a flowchart for a method of cleaning fabric using the disclosed system in accordance with an exemplary embodiment of the present invention.

FIG. 16 illustrates a method for cleaning fabric in accordance with an exemplary embodiment of the present invention. At step 1600, a piece of fabric (e.g., textile, clothing, sheets, garment, etc.) may be received. A washing machine described in reference to FIGS. 1-15 may receive the piece of fabric. The piece of fabric may be situated on a hanger. The piece of fabric may be manually spread on a horizontal plate. The piece of fabric may be automatically spread on a horizontal plate. The piece of fabric may be manually spread on a conveyor between screened belts. The piece of fabric may be automatically spread on a conveyor between screened belts. The washing machine may be a wardrobe type washing machine, such as the washing machine illustrated in FIGS. 7A, 7B, and 14. The washing machine may be an industrial conveyor type washing machine, such as the washing machines illustrated in FIGS. 8-12.

At step 1601, the piece of fabric may be wet. The washing machine may wet the piece of fabric. Wetting the piece of fabric may comprise emitting washing liquid (detergent solution, dry cleaning liquids, water, solvents, etc.) from an emitting header (such as the first header 101) through a channel (such as the conduit 301) at a desired soak temperature on to a surface of the piece of fabric in order to start a soaking process. The desired soak temperature may be greater than or equal to 5 C°. The desired soak temperature may be less than or equal to 100 C°. The amount of time for the soaking process may depend on a type of dirt, stain, and washing liquid. The emitting header may be moved along the piece of fabric to wet an entirety of the piece of fabric. The piece of fabric may move across one or more stationary emitting headers to wet an entirety of the piece of fabric.

At step 1602, the piece of fabric may be cleaned. The washing machine may clean the piece of fabric. Cleaning the piece of fabric may comprise emitting washing liquid (detergent solution, dry cleaning liquids, water, solvents, etc.) from a channel (such as the conduit 301) of the emitting header. Cleaning the piece of fabric may comprise activating (e.g., starting, engaging, etc.) the washing part (such as the cleaning component 302) of the emitting header. The liquid may enter a suction header (such as the second header 102) via a suction nozzle (such as the suction nozzle 305) after passing through the piece of fabric. Suction force may route the washing liquid away from the piece of fabric. One or more emitting header and suction header pairs may be moved along the piece of fabric to treat (e.g., clean, etc.) an entirety of the piece of fabric. The piece of fabric may move across one or more stationary emitting header and suction header pairs to treat an entirety of the piece of fabric.

At step 1603, the piece of fabric may be rinsed. The washing machine may rinse the piece of fabric. Rinsing the piece of fabric may comprise emitting water and/or dry cleaning liquid from a channel (such as the conduit 301) of the emitting header. The water and/or dry cleaning liquid may enter a suction header via a suction nozzle (such as the suction nozzle 305) after passing through the piece of fabric. Rinsing the piece of fabric may comprise activating the washing part (such as the cleaning component 302) of the emitting header.

At step 1604, the piece of fabric may be dried. The washing machine may dry the piece of fabric. Drying the piece of fabric may comprise readjusting a position of an emitting header relative to a suction header such that a gas-blowing channel (such as the conduit 304) from the emitting header is positioned to be in front of a suction nozzle (such as the suction nozzle 305) of a suction header. Dry air at a desired drying temperature may be blown from the gas-blowing channel through the piece of fabric and into the suction nozzle. The desired drying temperature may be in the range of 30 C° to 100 C°. Drying the piece of fabric may comprise blowing dry air on the piece of fabric until the piece of fabric is dried completely. One or more emitting header and suction header pairs may be moved along the piece of fabric to dry an entirety of the piece of fabric. The piece of fabric may move across one or more stationary emitting header and suction header pairs to dry an entirety of the piece of fabric.

At step 1605, the piece of fabric may be steamed. The washing machine may steam the piece of fabric. Steaming the piece of fabric may comprise blowing steam via a gas-blowing channel (such as the conduit 304) from an emitting header, through the piece of fabric, and to a suction nozzle (such as the suction nozzle 305) of a suction header.

At step 1606, deodorant may be sprayed on the piece of fabric. The washing machine may spray deodorant on the piece of fabric.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the invention. This description should be read to include one or at least one and the singular also includes the plural unless it is obvious that it is meant otherwise.

Upon reading this disclosure, those of skill in the art will appreciate still additional alternative structural and functional designs for a system and a process for cleaning fabric through the disclosed principles herein. Thus, while particular embodiments and applications have been illustrated and described, it is to be understood that the disclosed embodiments are not limited to the precise construction and components disclosed herein. Various apparent modifications, changes and variations may be made in the arrangement, operation and details of the method and apparatus disclosed herein without departing from the spirit and scope defined in the appended claims.

What is claimed is:

1. An apparatus for cleaning a fabric article, wherein the apparatus comprises:

an emitting header that emits fluid towards the fabric article; and a suction header directly opposite of the emitting header, wherein the suction header suctions the fluid emitted by the emitting header, wherein the suction header and the emitting header are parallel to each other and separated from each other by a space, wherein the space is configured for positioning the fabric article in the space so that fluid emitted by the emitting header flows along a fluid flow path through the fabric article towards the suction header, and wherein the emitting header and the suction header are arranged so that an angle of the fluid flow path is approximately zero degrees such that the fluid flows through the fabric article from the emitting header directly into the suction header.

2. The apparatus of claim 1, wherein the fluid emitted by the emitting header is at least one of: water, detergent, steam, dry air, dry cleaning liquid, and deodorant.

3. The apparatus of claim 1, wherein the emitting header and the suction header are configured to move relative to the fabric article.

4. The apparatus of claim 1, wherein the emitting header and the suction header are configured to move relative to each other.

5. The apparatus of claim 1, wherein the emitting header comprises a cleaning component.

6. The apparatus of claim 5, wherein the cleaning component is at least one of: an ultrasonic transducer, a rotating brush, pressurized liquid jets, a mixture of an air-liquid jet, and mechanical vibrators.

7. The apparatus of claim 5, wherein the cleaning component is configured for at least one of: creating mechanical vibration, creating cavitation, and brushing the fabric article.

8. The apparatus of claim 1, wherein the emitting header comprises rollers that interface with the fabric article and facilitate movement of the emitting header relative to the fabric article.

9. The apparatus of claim 1, wherein the suction header comprises a suction nozzle.

10. The apparatus of claim 1, wherein the emitting header comprises a dry air conduit and the suction header comprises a suction nozzle, and wherein the emitting header and the suction header are configured to move relative to each other so that the dry air conduit and the suction nozzle are aligned with each other during a drying procedure.

11. The apparatus of claim 1, wherein the suction header comprises rollers and a screen, wherein the screen is configured for directly contacting the fabric article, such that the screen is disposed between the rollers and the fabric article.

12. A washing appliance for cleaning a fabric article, wherein the washing appliance comprises:

a pump;

a water compartment;

an emitting header that emits fluid towards the fabric article, wherein the pump is configured to pump the fluid to the emitting header;

a suction header directly opposite of the emitting header, wherein the suction header suctions the fluid emitted by the emitting header, wherein the suction header and the emitting header are parallel to each other and separated from each other by a space;

and a motor in communication with at least one of the emitting header and the suction header, wherein the appliance is configured so that the fabric article is disposed in the space between the emitting header and the suction header during a cleaning procedure so that fluid emitted by the emitting header flows along a fluid flow path through the fabric article towards the suction header, and wherein the emitting header and the suction header are arranged so that an angle of the fluid flow path is approximately zero degrees such that the fluid flows through the fabric article from the emitting header directly into the suction header.

13. The apparatus of claim 12, wherein the fluid emitted by the emitting header is at least one of: water, detergent, steam, dry air, dry cleaning liquid, and deodorant.

14. The apparatus of claim 12, wherein the emitting header and the suction header are configured to move relative to the fabric article.

15. The apparatus of claim 12, wherein the emitting header and the suction header are configured to move relative to each other.

16. The apparatus of claim 12, wherein the emitting header comprises a cleaning component.

17. The apparatus of claim 16, wherein the cleaning component is at least one of: an ultrasonic transducer, a rotating brush, pressurized liquid jets, a mixture of an air-liquid jet, and mechanical vibrators.

18. The apparatus of claim 16, wherein the cleaning component is configured for at least one of: creating mechanical vibration, creating cavitation, and brushing the fabric article.

19. The apparatus of claim 12, wherein the emitting header comprises rollers that interface with the fabric article and facilitate movement of the emitting header relative to the fabric article.

20. The apparatus of claim 12, wherein the suction header comprises a suction nozzle.

21. The apparatus of claim 12, wherein the emitting header comprises a dry air conduit and the suction header comprises a suction nozzle, and wherein the emitting header and the suction header are configured to move relative to each other so that the dry air conduit and the suction nozzle are aligned with each other during a drying procedure.

22. The apparatus of claim 12, wherein the suction header comprises rollers and a screen, wherein the screen is configured for directly contacting the fabric article, such that the screen is disposed between the rollers and the fabric article.

* * * * *